United States Patent [19]

Johnson et al.

[11] Patent Number: 4,471,684

[45] Date of Patent: Sep. 18, 1984

[54] TRANSOM MISSILE LAUNCHER MODULE

[75] Inventors: Carl T. Johnson, Minneapolis; Edward R. Betzold, Golden Valley, both of Minn.

[73] Assignee: FMC Corporation, Chicago, Ill.

[21] Appl. No.: 301,847

[22] Filed: Sep. 14, 1981

[51] Int. Cl.[3] ..... F41F 3/04

[52] U.S. Cl. ..... 89/1.815; 89/1.8; 89/1.817

[58] Field of Search ..... 89/1.815, 1.816, 1.817, 89/1.819, 1.8

[56] References Cited

U.S. PATENT DOCUMENTS

| | | | |
|---|---|---|---|
| 3,106,132 | 10/1963 | Biermann et al. | 89/1.815 |
| 3,120,709 | 2/1964 | Madden | 89/1.8 X |
| 3,166,976 | 1/1965 | Bauer et al. | 89/1.805 |
| 3,228,293 | 1/1976 | Kane et al. | 89/1.8 |
| 3,262,366 | 7/1966 | Bauer et al. | 89/1.8 |
| 3,303,740 | 2/1967 | Grayson et al. | 89/1.815 |
| 3,340,768 | 9/1967 | Aldrin et al. | 89/1.815 |
| 3,742,814 | 7/1973 | Kroh | 89/1.8 |
| 3,892,162 | 7/1975 | Phillips | 89/1.815 |
| 4,134,328 | 1/1979 | Asp et al. | 89/1.817 |

*Primary Examiner*—David H. Brown

*Attorney, Agent, or Firm*—Henry M. Stanley; Richard B. Megley

[57] ABSTRACT

A transom missile launching system is configured to mount rigidly above the water line on the stern of ships designated to carry missile type ordnance. The missile launcher consists of two symmetrical modules containing eight missile cells each. Missiles are launched in the normal mode from a "all up round" canister at a fixed angle of about 60° from a line athwartship both to port and to starboard. At this angle the probability of launch into a wave in heavy seas due to ship roll is eliminated. The missiles propulsion motor exhaust gases are vented directly overboard at launch without being directed either within the ship or across the weather deck. At ignition a water tight cover at the base of the launching chamber is blown directly overboard into the water by the exhaust gas pressure and a path is therefore provided for the exhaust gas to be discharged directly into the sea.

18 Claims, 9 Drawing Figures

TRANSOM MISSILE LAUNCHER MODULE

BACKGROUND OF THE INVENTION

1. Field of the Invention

This invention relates to a missile launching mechanism, and more particularly to such a launching mechanism for use on board ship.

2. Description of the Prior Art

Shipboard missile launching systems have been developed in the past wherein a missile is hermetically sealed in a shipping and launch canister. One system is called the armored box launcher which is a relatively heavy system and provides a relatively small missile capacity (four per launcher). Another scheme is embodied in the vertical launching system which involves extensive retrofit and ship modification. The vertical launching system is expensive, requires dry docking of the ship to effect the retrofit, and requires large internal ship volume. This latter system also adds considerable weight to the ship and, while providing a sizeable missile capacity, reduces other offensive and defensive ship armament capacities.

One such vertical launching system is fully described in U.S. application Ser. No. 153,995, filed May 28, 1980, now U.S. Pat. No. 4,363,257 for a Strike Down Service Mechanism For A Vertical Launching System, assigned to the assignees of record herein.

SUMMARY OF THE INVENTION

Apparatus is disclosed for shipboard storing and launching of missiles wherein a support structure is adapted to be fixed to an external surface of a ship's hull. A launcher housing is attached in fixed relationship to the support structure. The housing has a plurality of side-by-side elongate missile storing and launching chambers wherein the chambers therein, have one elevated end and an opposite lower end. Means is enclosed by the housing for supporting within the chambers. The lower end of each of the launching chambers has a gas discharge passage communicating the chamber with an overboard exhaust port. A cover assembly is attached to the elevated end of each chamber in a fashion such that a cover for each chamber is movable between a closed protective position and an open out-of-the-way position.

DESCRIPTION OF THE PREFERRED EMBODIMENTS

Figure 1:
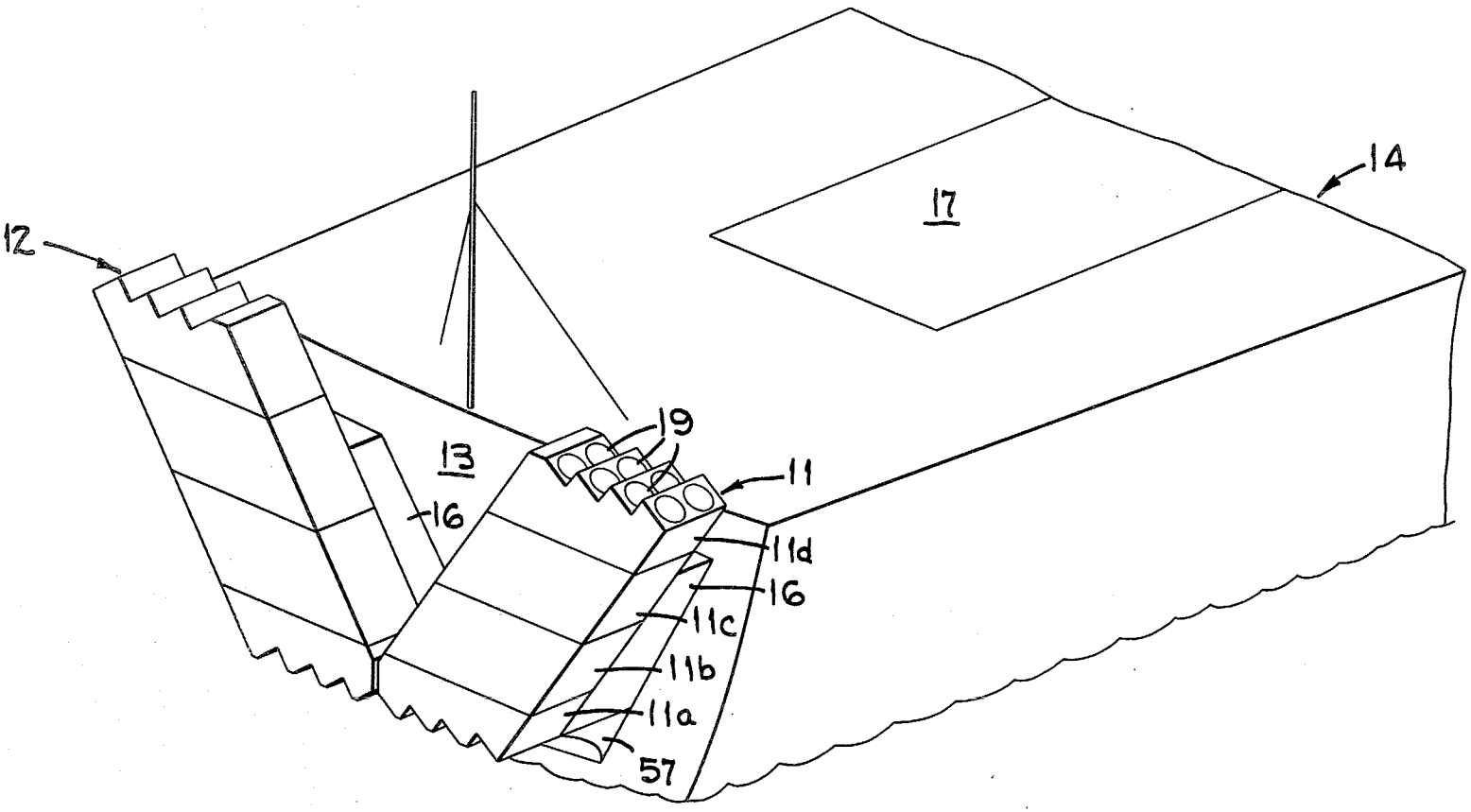
FIG. 1 is a perspective view of the transom launching module of the present invention installed on the transom of a ship.

The basic transom missile launcher module is best shown in FIG. 1. Two similar eight cell launcher modules shown generally at 11 and 12 are supported at a transom 13 on a ship 14 by means of a support structure 16 extending therebetween. Each of the modules 11 and 12 accommodate eight missiles in hermetically sealed canisters wherein the canisters are approximately 250 inches long and twenty-one inches in diameter. A ship of sufficient size to carry the two modules (sixteen missiles) shown in FIG. 1 may also have an aft located helicopter pad 17. It is important that any missile launching system not detract from the ship's other operational capabilities, and therefore the missile launching system disclosed herein has relatively little affect on the helicopter operation or any of the ship's other ordnance delivery systems.

The support structure 16 encloses a module access compartment to be hereinafter described. Using the same type of support structure two single four cell modules (eight missiles) could be used on ships unable to accommodate the weight of the sixteen missile system. For even smaller ships a single four cell module supported by structure 16 might be mounted on the centerline of a ship's transom for firing to one side only. It should be noted that the missile launching module lower end is spaced above the ship's waterline (FIG. 1).

Figure 5:
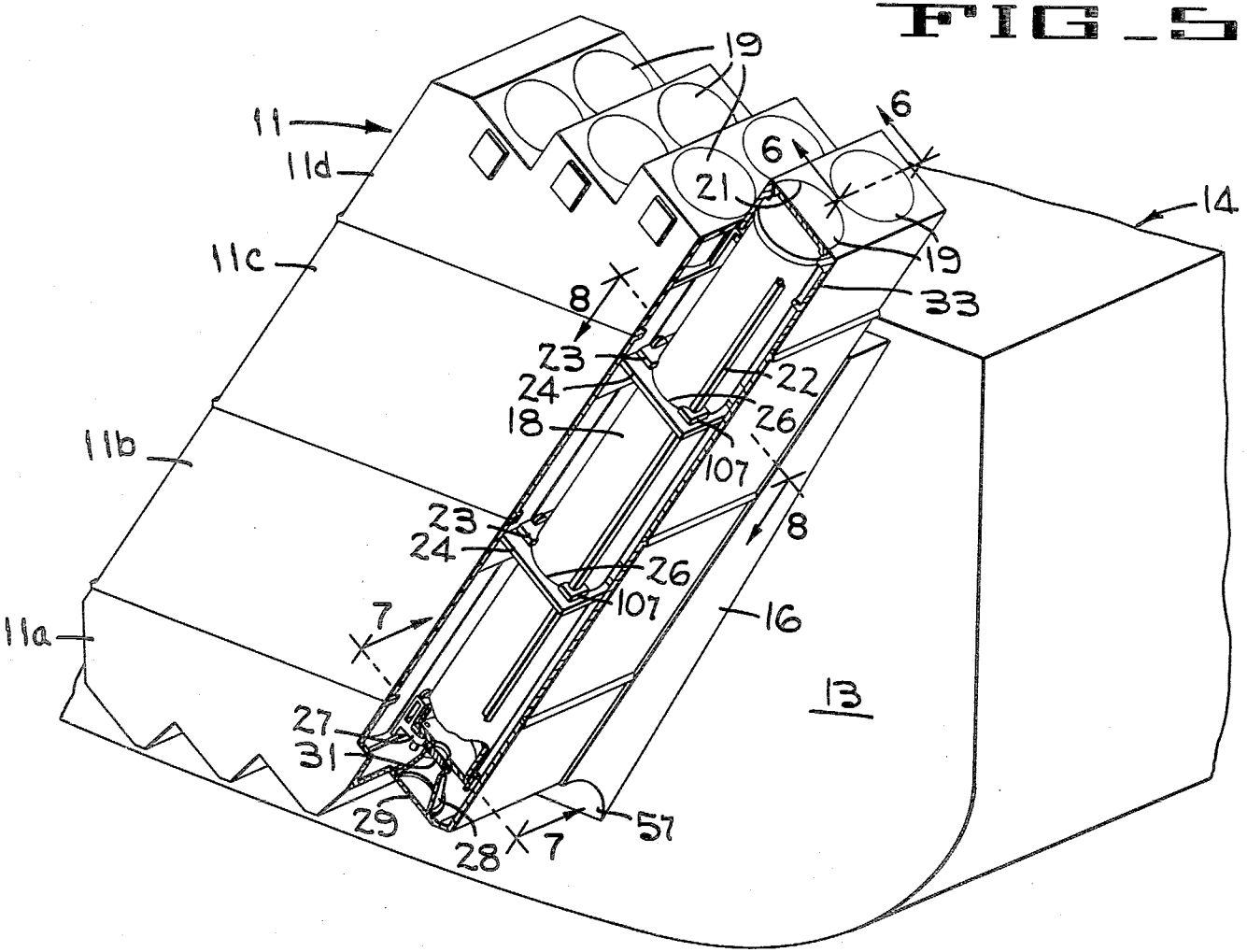
FIG. 5 is a partial perspective view partly cut away of an eight chamber transom launcher module of the present invention.
Figure 7:
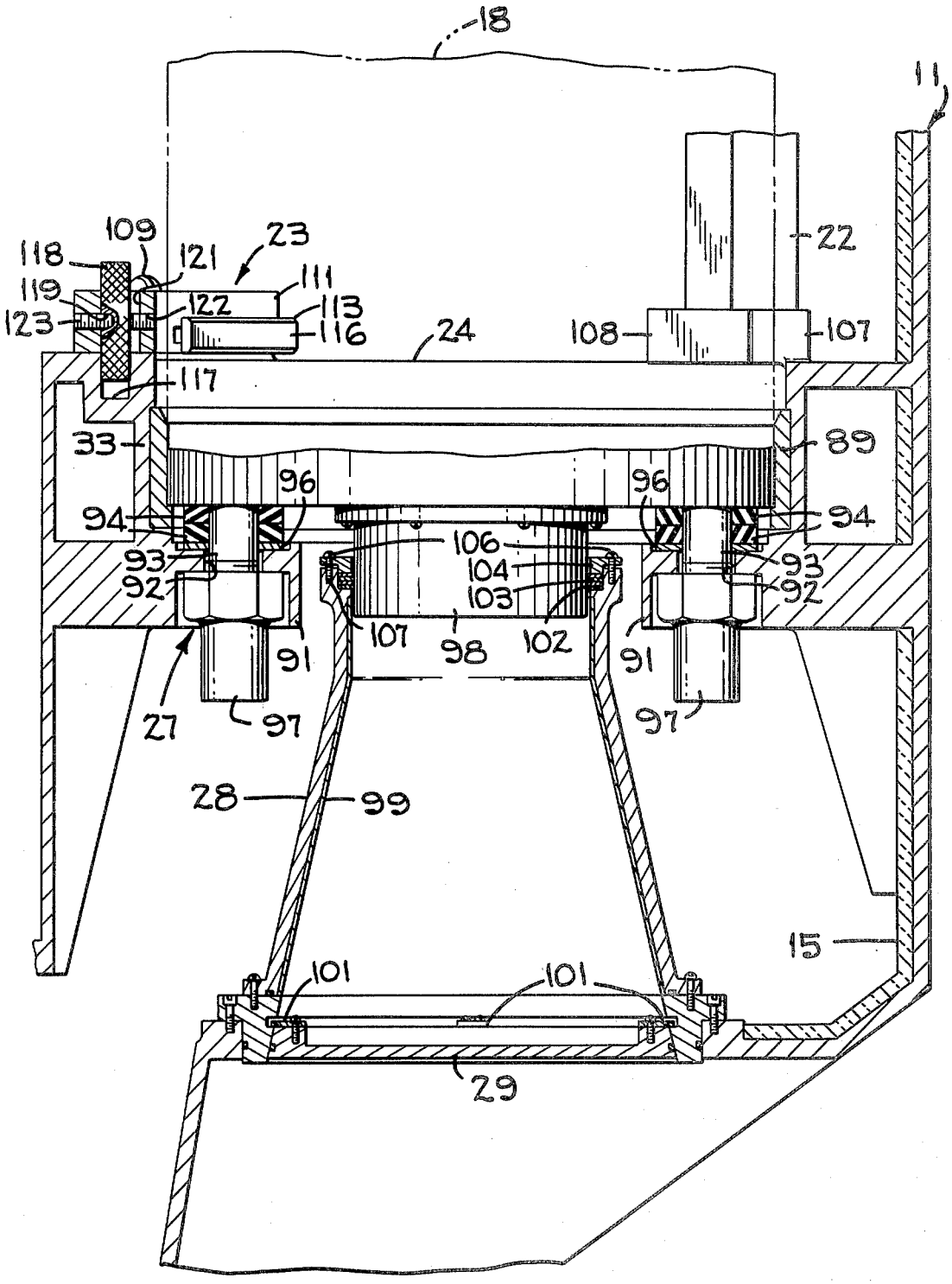
FIG. 7 is a partial sectional view along the line 7—7 of FIG. 5.

The eight cell launcher module is shown with part of the module external structure cut away in FIG. 5. Each module 11 and 12 includes four parallel sided box structures 11*a, b, c* and *d* (FIG. 5) which, when joined together end to end, total about twenty-four feet in length. This length accommodates the aforementioned missile length. The launcher module is about ten feet wide in the athwartship direction and about five feet deep in the fore and aft direction. Each module long axis is elevated about 60° from the horizontal. The exterior surface of the launcher module housing is fabricated from half inch steel plate. Additional protection and insulation is supplied by an internal one inch thick Kevlar TM layer 15. (FIG. 7).

A hermetically sealed canister 18 is shown in FIG. 5 positioned within one of eight missile receiving chambers in the module 11. The canister contains an "all up round" or a ready to fire missile. When loading the canisters in the chambers within the launcher module, a muzzle cover 19 is deployed to an out-of-the-way position at the elevated end of the module and the lower end of the canister 18 is introduced through an upper opening 21 in the chamber by means of an appropriate strike-down mechanism for the missile canisters. The lower side of the canister is engaged by a pair of rails 22 (one shown in FIG. 5) so that the canister is guided toward the bottom of the chamber as it is lowered by the strike-down mechanism. When the canister is fully lowered in the chamber, a lower seal, to be hereinafter described, is formed between the lower end of the canister and the chamber wall and an upper seal, also to be hereinafter described, is formed between the upper end of the canister and the chamber wall. The canister is secured in the chamber by means of movable chocks 23 which are urged toward the periphery of the canister at hard points thereon by mechanism also to be hereinafter described. There are a number of ribs 24 spaced axially along each chamber. The ribs have central openings 26 therein through which the canister extends when loaded in the chamber. The ribs provide structural strength to the module as well as serving to locate the rails 22 and the chocks 23.

A lower canister support 27 is shown in FIG. 5. Appropriate connectors are provided at the bottom of each chamber which mate with the canister connectors to provide power and signal data to the missile round enclosed in the canister. An exhaust cone 28 is provided at the bottom of each launching chamber in the module and may have a weather cover 29 inserted in the bottom portion thereof to protect an inner heat resistant surface in the exhaust cone from corrosion by weather elements and sea water. The bottom portion of the hermetically sealed canister 18 is also shown cut away to illustrate a bottom plug 31 in the canister which is blown out by missile propulsion engine gases when the engine is fired. The weather cover is also blown out by the firing of the missile propulsion engine so that the exhaust gases are dumped overboard into the sea through the port provided by the exhaust cone.

Figure 6:
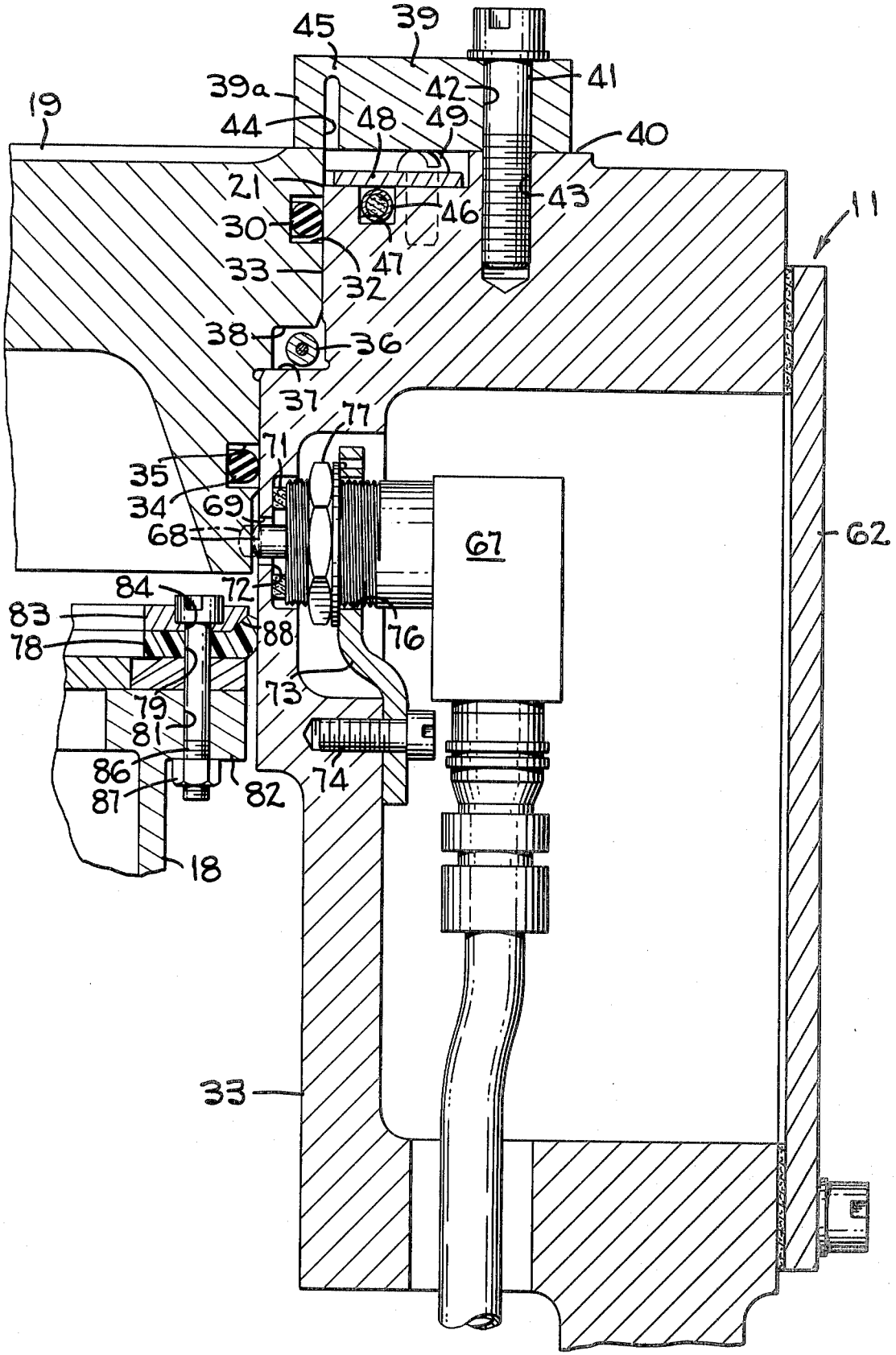
FIG. 6A is a partial sectional view along the line 6—6 of FIG. 5.
FIG. 6B is a partial sectional view of an alternate embodiment along the lines 6—6 of FIG. 5.
Figure 6A:
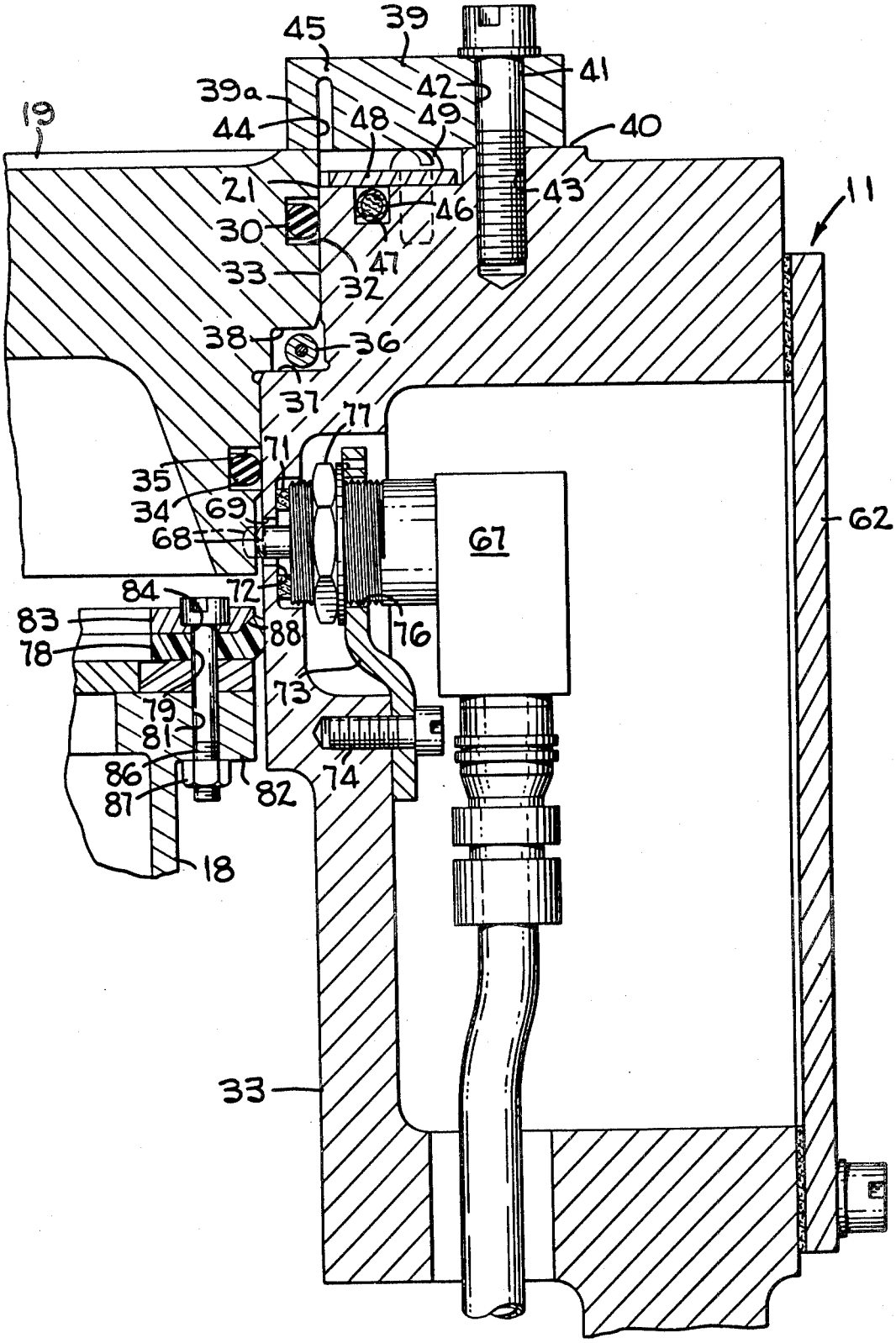
Figure 6B:
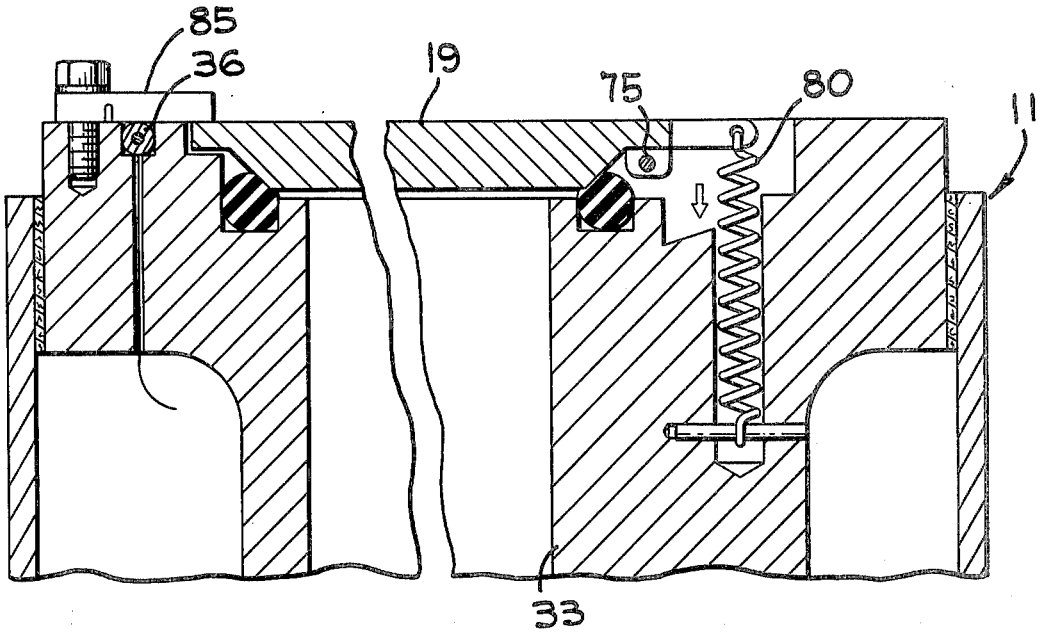

With reference now to FIG. 6 the details of the muzzle cover 19 will be described. The muzzle cover shown in FIG. 6 is a "blow-out" cover which is set in place to provide protection for the muzzle end of the launching chamber. A larger diameter ring seal 30 is shown within a groove 32 extending around the periphery of the cover. This ring seal effects a seal between the cover 19 and a portion of an inner wall 33 of the missile chamber. The inner wall 33 of the chamber is terminated at the upper end at the opening 21 (FIG. 5) which receives the cover 19. A smaller diameter ring seal 34 is disposed in a separate groove 35 running around the periphery of the cover 19. The smaller diameter seal effects a seal between the cover and another portion of the chamber wall 33. An expulsion or ejection charge 36 (having a rope or cord like form) is situated on a shoulder 37 formed on the chamber wall 33. A shoulder 38 formed on the cover 19 between the grooves 32 and 35 overlies the ejection charge. The charge therefore lies between the seals 30 and 34. The seals serve to isolate the charge 36 from the external environment and from the environment inside the launcher module prior to cover "blow-out" at the time of missile launching.

The cover 19 is retained within the upper opening 21 by means of a plurality of shear blocks 39. The shear blocks are fastened to an upper face 40 surrounding each of the openings 21 by means of screws 41 which pass through holes 42 therein and engage threads in threaded bores 43 in the face. Each shear block has a slot 44 cut therein near the end thereof. The slots then define an end portion 39*a* on each shear block. A relatively small section of shear block material 45 remains at the end of the slot to connect the end portion 39*a* to the remainder of the shear block. The end portion 39*a* is positioned to overlie the edge of the cover 19 so that when the charge 36 is detonated the end portions break away from the shear blocks and the cover is free to be removed by the charge 36 to an out-of-the-way position so that the opening 21 is clear to allow a missile emerging from the canister 18 to pass therethrough.

It should also be noticed in FIG. 6 that an electrical heating element 46 is placed within a groove 47 in the face 40 surrounding the opening 21. The heating element may be any one of a number of known types. The heating element is retained within the groove 47 by means of an annular disc 48 which is retained on the face 40 by means such as the screws 49 as shown. The heating element serves the purpose of preventing ice formation and buildup at the periphery of the cover 19 so that when the charge 36 is ignited, an ice build up will not prevent "blow-out" of the cover 19.

With further reference to FIG. 6 a micro switch 67 is shown having an axially moving plunger arm 68 extending therefrom. The plunger arm is held in the depressed position by the depending flange on the cover 19 while the cover is in place within the opening 21. The plunger arm extends through the wall 33 of the missile chamber due to access provided by a hole 69 in the wall. An annular seal 71 is disposed between a surface 72 surrounding the hole 69 and the face of the switch 67 through which the plunger arm 68 extends. A bracket 73 is attached to the side of the chamber wall 33 remote from the chamber by means of screws 74. A hole 76 extends through the switch bracket. A nut 77 engages threads on that portion of the switch through which the switch plunger arm 68 extends after that switch portion is inserted through the hole 76. Appropriate conductors are attached to the micro switch 67 as shown so that a switch contact configuration indicating the cover 19 is in place may be obtained for the position of the switch plunger arm 68 shown in solid lines in FIG. 6. A switch contact configuration indicating the cover 19 has been moved to an out-of-the-way position from the opening 21 is provided when the switch plunger arm 68 takes the position shown in dashed lines in FIG. 6. Access to the switch may be had through an opening through the launcher module which is closed by a sealed cover 62. There is one such opening and cover for each missile chamber.

An upper seal is provided between the upper portion of the canister 18 and the wall 33 of the chamber holding each canister. Such a seal is shown as item 78 in FIG. 6 which is an annular disc shaped elastomeric member which extends around the periphery of the upper end of the canister. The seal 78 has a plurality of holes 79 therein which are in matching pattern with a plurality of holes 81 extending through an upper rim or flange 82 on the canister 18. An annular seal retaining ring 83 is formed having a plurality of holes 84 which are arranged in a pattern which registers with the holes 79 and 81. Screws 86 are passed through the registered holes 84, 79 and 81 and are retained therein by means of retaining nuts 87 which threadably engage the screws. The retaining ring 83 has chamfer 88 formed on the underside thereof so that when the nuts 87 are drawn tightly onto the screws 86 the retaining ring 83 is brought into pressure engagement with the seal 78 and the seal is consequently squeezed into pressure contact with the wall 33. There is therefore no communication between the portion of the chamber beneath the cover 19 and the remainder of the module access department. In this fashion when the cover 19 is placed in an out-of-the-way position preparatory to firing the missile from the canister, the missile access compartment is still isolated from the environment external to the transom missile launcher modules 11 and 12.

Alternatively the cover 19 may be hinged to the launcher module 11 as at 75. A spring 80 may then be positioned between the cover 19 and the launcher module 11 (or 12) structure so that when unlatched the cover will be urged to an open or "out-of-the-way" position by the spring, thereby clearing the muzzle of the launching chamber. The cover may be retained in a closed protective position by a latch as at 85 which is actuated electrically from a control (not shown) for the launcher module.

With reference now to FIG. 7, a section is taken through the lower end of a chamber containing a canister 18 within one of the launching modules 11 and 12. The missile canister 18 is engaged at the lower end thereof by a cylindrical seal 89 which is seated in the lower end of the chamber abutting the lower reaches of the chamber wall portions 33. The cylindrical seal is not an environmental seal, but merely functions to isolate the bottom of the missile canister where the missile access connectors are located from the upper portion of the canister. This is deemed to be desirable so that if a sprinkler system (not shown) which may be located within the chambers accepting the canisters is discharged, the water or fire retardant will not foul the missile connector area. The bottom end of the canister is configured to accept an electrical umbilical and a pyro cable so that appropriate electrical signals may be communicated to the missile through the canister wall for purposes of guidance and fire control.

A pair of opposing lower canister support tangs 91 are shown extending into the chamber at the bottom end thereof in FIG. 7. The tangs have a hole 92 therethrough which each accept a stud 93 extending from the lower end of the canister. A pair of spacers 94 having some measure of elasticity are positioned surrounding each stud between the bottom of the canister and the upper surface of the tang 91. A disc shaped washer 96 is disposed between the spacers and the tang. A cap nut 97 engages threads on the studs 93 and bears against the underside of the tang to secure the canister 18 longitudinally in the chamber. It may be seen that because of the elastomeric nature of the spacers 94, the canister may move some predetermined amount longitudinally within the chamber so that the canister is sufficiently isolated from longitudinal shock and vibration.

The canister 18 has a tail piece 98 thereon which extends through an aperture in the lower end of the canister receiving chambers. The tail piece is substantially cylindrical in shape. The exhaust cone 28 mentioned hereinbefore is fastened to the launcher structure at the lower end of each missile chamber having an axis therethrough substantially in alignment with the axis of the tail piece 98. The exhaust cone has a consumable coating 99 on the inner surface thereof which is carried away in part when the propulsion engine for the missile within the canister is fired. The coating serves to protect the exhaust cone during firing so that the cone may provide a path for the propulsion engine gases which leads overboard from the launcher module structure. The exhaust cone may be seen to be appropriately attached by means of screws to the launcher module structure in FIG. 7.

An annular step 102 may be seen to be formed at the inner surface of the exhaust cone near the top thereof. A packing seal 103 is supported in the annular step and a packing gland 104 is positioned to rest atop the packing seal. The packing gland is seen to be attached to the upper end of the exhaust cone 28 by means of screws 106. When the screws are engaged with threads in a series of tapped holes 107 around the upper face of the exhaust cone and tightened therein, the packing gland is caused to exert pressure on the upper surface of the packing seal to thereby cause it to expand laterally as seen in FIG. 7. The lateral expansion thereby provides a seal between the periphery of the tail piece 98 and the inner surface of the exhaust cone 28 at the step 102.

It should also be noted in FIG. 7 that the weather cover 29 mentioned hereinbefore is retained at the flared end of the exhaust cone by means of shear blocks 101 similar to but smaller than, the shear blocks 39 which retain the cover 19 on the muzzle end of the launching chambers. The pressure of the propulsion engine exhaust gases is such as to exceed the sheer strength of the blocks 101 and the weather cover is thereby jettisoned overboard upon firing the propulsion engine. The lower rib 24 having the lower movable chocks 23 associated therewith may also be seen in FIG. 7. The lower end of one of the rails 22 is also apparent in FIG. 7.

Figure 8:
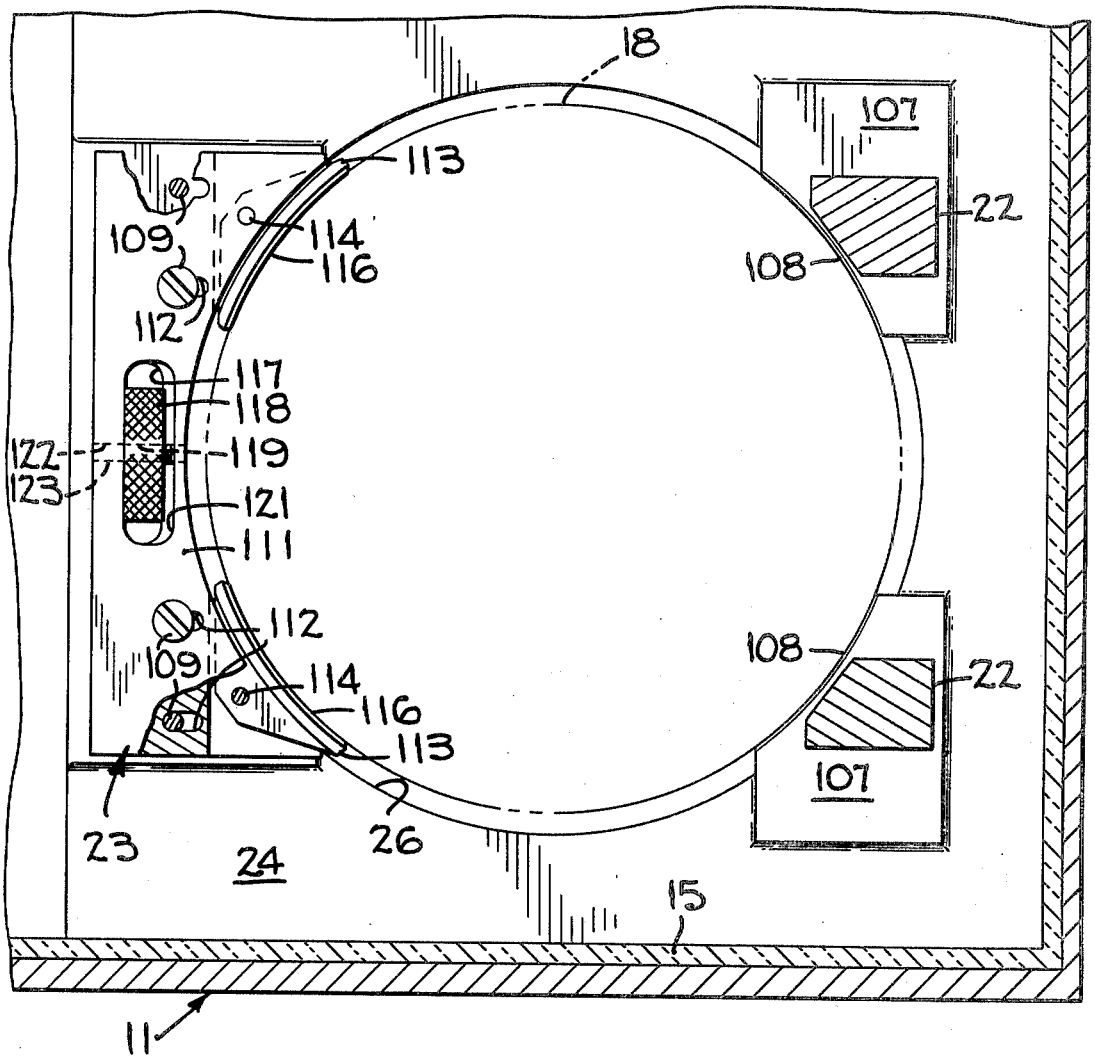
FIG. 8 is a partial sectional view along the line 8—8 of FIG. 5.

A description of the chocks which support a missile within a chamber is undertaken with reference to FIG. 8 of the drawings. At each of the ribs 24 located along the length of each chamber for receiving a missile canister 18, there is positioned a fixed chock 107 having a low friction layer 108 on the face thereof. Any low friction plastic with acceptable wear characteristics and the capability of surviving in a marine environment is acceptable. The face of the fixed chocks are contoured to contact the periphery of the canister 18 substantially along the entire face 108 at hard points on the missile canister. The movable chock assembly 23 is shown attached to the rib plate 24 by means of four screws 109 which engage threaded holes (not shown) in the rib plate. The movable chock assembly includes a sliding plate 111 having four elongate holes 112 therethrough. The screws 109 pass through the elongate holes 112. The plate 111 is thereby allowed to move toward and away from the missile canister 18 through a limited distance because of the elongate holes 112. The chock plate has a shoe 113 attached to each end thereof by means of pivot pins 114. Each of these shoes has a low friction plastic layer 116 on the face thereof. The faces are contoured to contact the periphery of the missile canister 18 substantially along the entire face at hard points on the missile canister.

A slot 117 is formed in the rib plate 24. The knurled knob 118 has substantially the same width as the slot 117. The knurled knob has a centrally located threaded hole 119 therethrough. A slot 121 is formed through the movable chock plate 111. The slot 121 has a greater width than the slot 117 in the chock plate. A through hole 122 is formed in the movable chock plate extending through the slot 121. A threaded shank 123 is placed through the hole 122 and the threaded hole 119 in the knurled knob to thereby support the knurled knob within the slot 121. The threaded shank is fixed in the movable chock plate and the knurled knob may therefore be turned on the threads in the central hole to move along the threaded shank from one side of the slot 121 to the other side thereof.

In assembling the movable chocks 23 on the rib plates 24 the sliding plate 111 is placed adjacent to one surface of the rib plate with a portion of the periphery of the knurled knob 118 extending into the slot 117 on the rib plate. The screws 109 are placed through the elongate slots 112 until they engage the threaded holes in the rib plate. The screws are turned into the threads in the rib plate to a point where the screw heads barely engage the movable chock plate 111. The knurled knob is then turned on the threaded shank 123 in a direction to advance the shoes 113 toward the periphery of the missile canister 18 at the aforementioned hard points thereon. The knurled knob is turned until the shoes firmly engage the periphery of the missile canister and the screws 109 are then tightened to firmly engage the chock plate 111 to thereby lock it in place. The shoes are properly positioned to engage the periphery of the missile canister along the entire face 116 because they are allowed to pivot about the pivot pins 114 as the knurled knob 118 is being turned to advance them toward the canister surface. The missile canister is therefore engaged in four places about the periphery thereof at each rib plate by the two faces 116 and the two faces 108. The engagement is obtained at hard points along the length of the missile canister by appropriately locating the axial position within the missile reception chambers for the rib plates.

Figure 2:
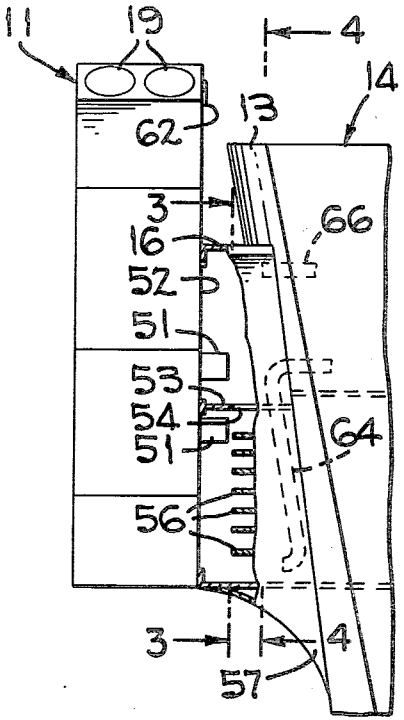
FIG. 2 is a side elevation view of the transom launching module of FIG. 1.

FIG. 2 shows the support structure 16 attached to the transom 13 of the ship 14. The support structure is partially cut away to show a pair of electrical junction boxes 51 extending forward from the forward bulkhead 52 of the launcher module 11. A middle platform 53 is shown having an open hatchway 54 therein. A series of steps 56 are fixed to the inside surface of the support structure 16 so that convenient access is provided between the middle platform and the bottom surface of the support structure. Like items will be given like item numbers in the launcher modules 11 and 12 which are substantially mirror images of one another. A fillet 57 extends from a lower point on the transom 13 to the bottom of the launcher module 11. The fillet functions as a wave deflector to avoid application of high force levels against the bottom of the support structure 16 and the launcher modules by wave action.

Figure 4:
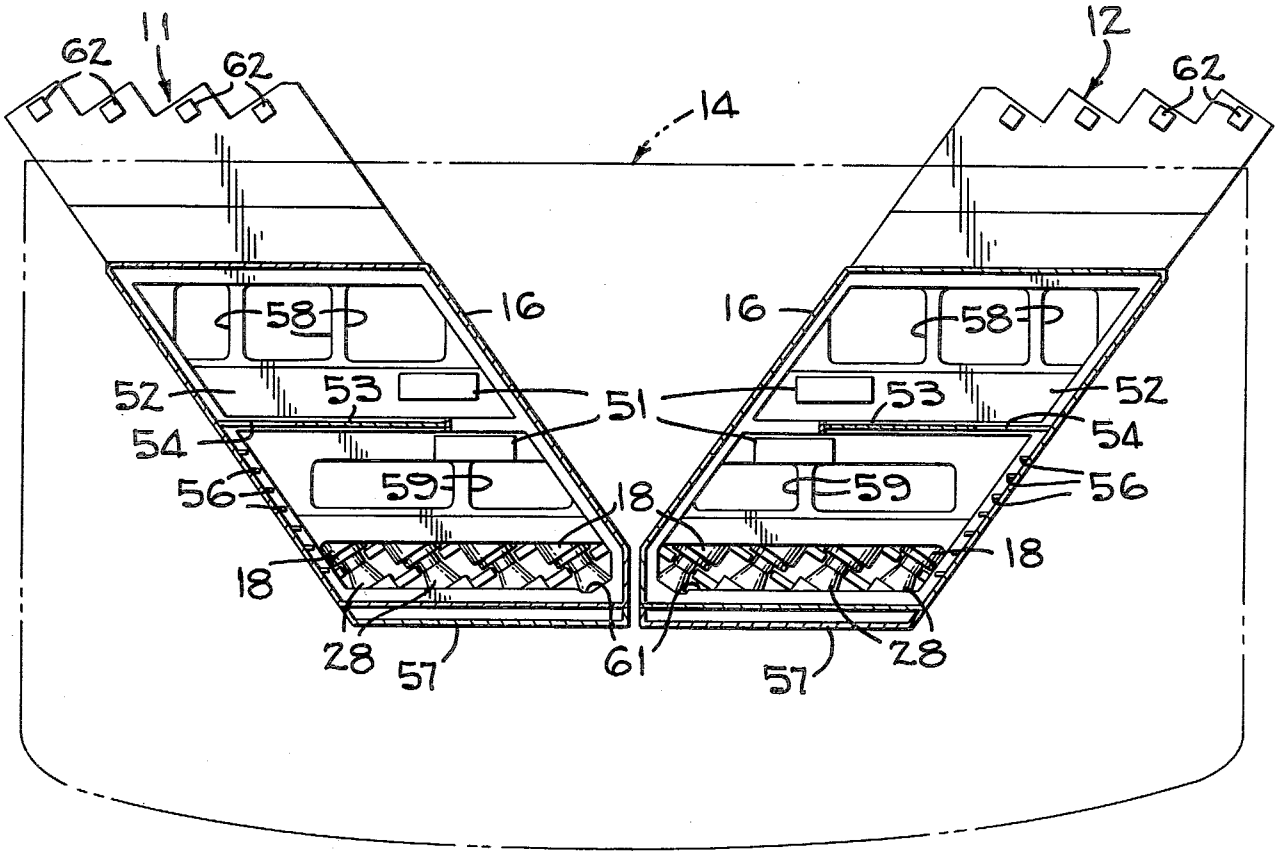
FIG. 4 is a sectional view along the line 4—4 of FIG. 2.

FIG. 4 is a sectional view through the support structure 16 looking aft toward the launching modules 11 and 12. The ship 14 is shown in phantom lines. The enclosure provided for each launching module by the support structure 16 is aptly demonstrated. A plurality of upper access ports 58 and lower access ports 59 are formed in the forward bulkhead of the launcher modules within the support structure boundaries. Access ports 58 and 59 will require cover plates if a sprinkler system, mentioned herein before, is required. Also temperature control heaters will be required in the modules since the ships ventilation system would be isolated from the modules. Access to the movable chocks 23 is thereby provided for on-loading and off-loading missile canisters 18. The upper chock access ports are accessible from the middle platform 53 and the lower chock access ports are accessible from the bottom platform in the module access compartment. An umbilical access port 61 is formed near the bottom of the bulkhead on the forward end of the launching module so that electrical connections may be made between the ship's fire control system and the bottom of the missile canisters 18. It may therefore be seen that any necessary access to the missile canisters in the eight missile chambers in a launching chamber 11 or 12 is provided through the plurality of ports from the module access compartment within the support structure 16.

Figure 3:
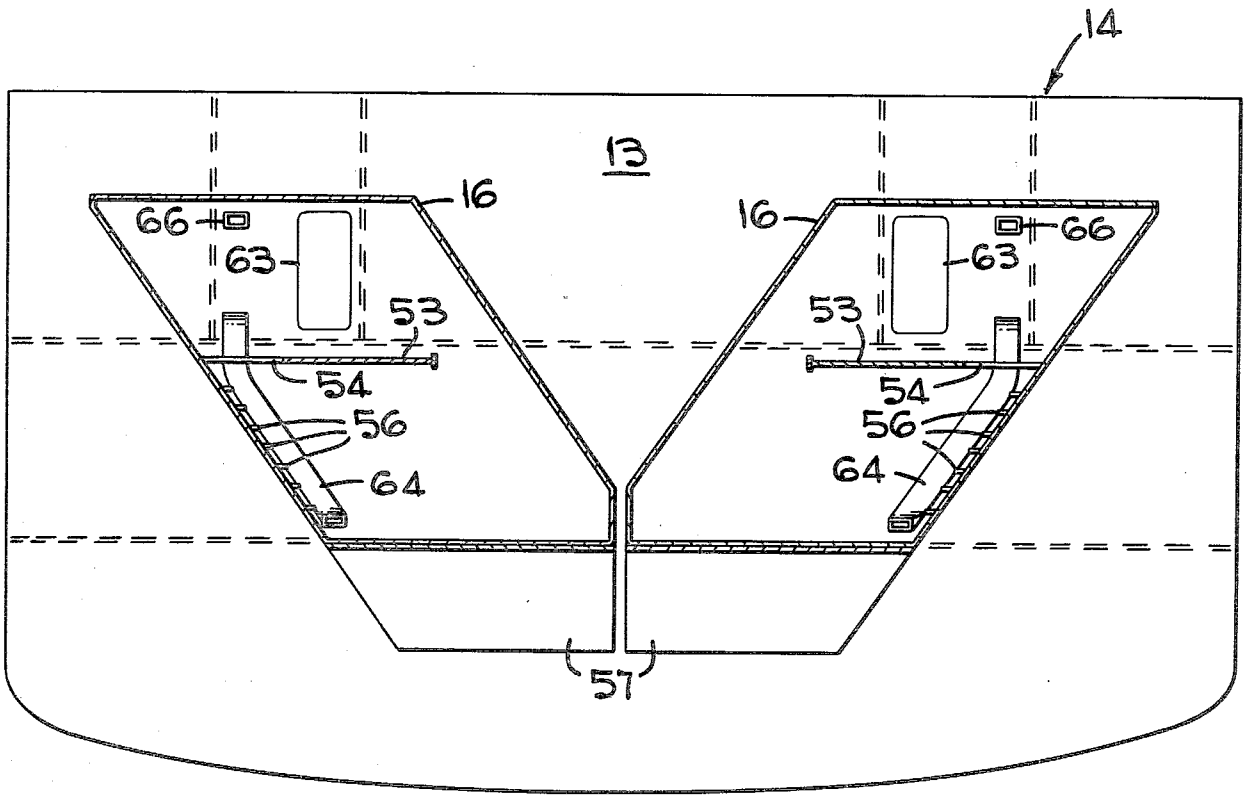
FIG. 3 is a sectional view along the line 3—3 of FIG. 2.

With reference now to FIG. 3 a view is taken through the module access compartment formed by the support structure 16 looking forward. A hatchway is cut into the transom 13 in communication with the module access compartment and closed by a 26"×54" quick acting water tight door 63. A person entering the module access compartment from the interior of the ship (from the second deck level) will step slightly down onto the middle platform 53 as shown. Quick access is then provided through the open hatchway 54 (FIG. 4) by means of the steps 56 to the bottom platform in the module access compartment. The environment in which the missiles are stored is controlled to that of the ship's internal air through a ship's ventilation system air inlet 64 to the module access compartment and by means of a ventilation return duct 66 near the upper reaches of the compartment. These ducts and their positions may also be seen in FIG. 2.

The launching modules 11 and 12 are formed to fit on some exterior surface of a ship's hull. In the context of this disclosure the ship's weather deck does not comprise a portion of the ship's hull. In the preferred embodiment the modules are shown mounted on the transom of the ship. It is envisioned however that such modules could be mounted to the sides of a larger ship as long as the lower ends of the chambers are above the water line.

Although the best mode contemplated for carrying out the present invention has been herein shown and described, it will be apparent that modification and variation may be made without departing from what is regarded to be the subject matter of the invention.

We claim:

1. Apparatus for shipboard storing and launching of missiles, comprising support structure adapted to be fixed to an external surface of a ship's hull portion, a launcher housing attached in fixed relationship to said support structure, said housing having a plurality of elongate missile storing and launching chambers therein, said chambers having one elevated end and an opposite lower end, means enclosed by said housing for supporting missiles within said chambers, said lower end of said chambers having a gas discharge passage communicating each of said chambers with an overboard exhaust port, and a cover assembly attached to each of said chamber elevated ends including a cover movable between a closed protective position and an open out-of-the-way position.

2. Apparatus as in claim 1 wherein said support structure comprises a continuous wall forming a missile module access compartment, a hatch providing access through the ship's hull portion and communicating the interior of the ship with said module access compartment, and a plurality of access ports communicating said module access compartment with said missile chambers, whereby missiles may be manually accessed during missile loading and unloading.

3. Apparatus as in claim 1 wherein said support structure comprises a continuous wall forming a missile module access compartment, said access compartment communicating with said missile storing and launching chambers, and means for communicating internal shipboard air with said module access compartment whereby the environment in said chambers is controlled.

4. Apparatus as in claim 1 wherein said means enclosed by said housing comprise a plurality of longitudinally spaced ribs, and a plurality of chock plates movably attached to said ribs for firmly engaging the outer surface of the missile structure in said chambers.

5. Apparatus as in claim 1 wherein said missile is enclosed in a canister and has a fly-through cover at the nose and a blow-out plug at the tail, further comprising a top seal engaging the periphery of the canister at the nose thereof and a bottom seal contacting the canister at the tail thereof, whereby the interior of the canister is open to ambient after a missile is fired therefrom, but the interior of said support structure and launcher housing is isolated from ambient.

6. Apparatus as in claim 1 wherein said elongate missile chambers are oriented substantially at sixty degrees above the horizontal.

7. Apparatus as in claim 1 wherein said cover assembly comprises a hinged cover, a spring attached between said hinged cover and said launcher housing, said spring operating to urge said cover toward said open position, and a latch retaining said cover in said closed position until released.

8. Apparatus as in claim 1 wherein said cover assembly comprises a blow-out cover, and an explosive release charge which when ignited causes said cover to be removed from said closed protective position.

9. Apparatus as in claims 7 or 8 wherein said cover assembly includes a cover position indicator switch which provides a switch condition in one state when the cover is closed and in another state when the cover is open.

10. Apparatus for storing missiles aboard ship in fire ready condition, comprising a support enclosure attached externally to the ship's transom, a launcher housing attached to said support enclosure, a plurality of side-by-side missile receiving means enclosed by said housing and defining a plurality of elongate missile storage and launching chambers each adapted to receive a missile, said chambers being oriented in said housing so that one chamber end is elevated over the other, a chamber cover disposed at said elevated end, means for moving said cover between a closed position and an out-of-the-way position, and means for forming a gas discharge passage communicating the lower end of each chamber with an overboard exhaust port.

11. Apparatus as in claim 10 wherein said support enclosure defines a missile module access compartment, a hatch in the transom communicating between the ship's interior and said module access compartment, and a plurality of access ports communicating said compartment and said missile chambers, whereby manual access is afforded to missiles during loading and unloading.

12. Apparatus as in claim 10 wherein said support enclosure comprises a continuous wall forming a missile module access compartment, said access compartment communicating with said missile storage and launching chambers, and means for communicating internal shipboard air with said module access compartment whereby the environment in said chambers is controlled.

13. Apparatus as in claim 10 wherein said missile receiving means comprises a plurality of longitudinally spaced ribs, and a plurality of chock plates movably attached to said ribs for firmly engaging the outer surface of the missile structure in said chambers.

14. Apparatus as in claim 10 wherein said missile is enclosed in a canister and has a fly-through cover at the nose and a blow-out plug at the tail, further comprising a top seal between the periphery of the canister and the chamber at the top thereof and a bottom seal between the canister and the chamber at the bottom thereof, whereby the interior of the canister is open to ambient after a missile is fired, but the interior of said support structure and launcher housing is isolated therefrom.

15. Apparatus as in claim 10 wherein said elongate missile chambers are oriented substantially at sixty degrees above the horizontal.

16. Apparatus as in claim 10 wherein said cover comprises a hinged cover, a spring attached between said hinged cover and said launcher housing operating to urge said cover toward said open position, and a latch retaining said cover in said closed position until released.

17. Apparatus as in claim 10 wherein said cover comprises a blow-out cover, and an explosive charge which when ignited causes said cover to be removed from said closed protective position.

18. Apparatus as in claims 16 or 17 wherein said cover includes a cover position indicator switch providing one switch state for cover closed and another switch state for cover open.

* * * * *